US007948466B2

(12) United States Patent
Lee

(10) Patent No.: US 7,948,466 B2
(45) Date of Patent: May 24, 2011

(54) CIRCUIT STRUCTURE FOR DUAL RESOLUTION DESIGN

(75) Inventor: Szu-Hsien Lee, Kaohsiung (TW)

(73) Assignee: Chimei Innolux Corporation, Chu-Nan (TW)

( * ) Notice: Subject to any disclaimer, the term of this patent is extended or adjusted under 35 U.S.C. 154(b) by 1014 days.

(21) Appl. No.: 11/386,339

(22) Filed: Mar. 22, 2006

(65) Prior Publication Data

US 2006/0232591 A1 Oct. 19, 2006

Related U.S. Application Data

(60) Provisional application No. 60/671,965, filed on Apr. 15, 2005.

(51) Int. Cl.
*G09G 3/36* (2006.01)

(52) U.S. Cl. ..... 345/100; 345/698

(58) Field of Classification Search ..... 377/64, 377/78, 79, 70, 74, 75, 76, 104–106; 345/98–100, 345/204, 698, 699
See application file for complete search history.

(56) References Cited

U.S. PATENT DOCUMENTS

| | | | | |
|---|---|---|---|---|
| 5,136,622 | A * | 8/1992 | Plus | 377/64 |
| 5,517,542 | A * | 5/1996 | Huq | 377/78 |
| 5,859,630 | A * | 1/1999 | Huq | 345/100 |
| 6,124,840 | A * | 9/2000 | Kwon | 345/100 |
| 6,856,307 | B2 * | 2/2005 | Osame et al. | 345/98 |
| 7,224,341 | B2 * | 5/2007 | Ishii et al. | 345/100 |
| 2003/0030615 | A1 * | 2/2003 | Maeda et al. | 345/90 |
| 2004/0008173 | A1 * | 1/2004 | Maeda et al. | 345/99 |
| 2005/0057556 | A1 | 3/2005 | Kubota et al. | |

FOREIGN PATENT DOCUMENTS

| | | |
|---|---|---|
| EP | 0615250 | 9/1994 |

* cited by examiner

*Primary Examiner* — Chanh Nguyen
*Assistant Examiner* — Tsegaye Seyoum
(74) *Attorney, Agent, or Firm* — Liu & Liu

(57) ABSTRACT

A dual resolution circuit for supporting normal resolution display mode and half resolution display mode is disclosed. In the dual resolution circuit, cascaded shift registers are controlled by a group of clock signals to generate intermediate scan signals in response to a start pulse. A normal/reverse scan switch, controlling a normal scan mode and a reverse scan mode, feeds back the intermediate scan signal from one shift register to another shift register. A dual resolution switch switches signal paths of the intermediate scan signals to logic gates. The logic gates perform logic operation on an enablement signal and the intermediate scan signals to generate final scan signals used in dual resolution display modes.

19 Claims, 13 Drawing Sheets

CIRCUIT STRUCTURE FOR DUAL RESOLUTION DESIGN

CROSS-REFERENCE TO RELATED APPLICATION

This application claims the priority benefits of U.S. provisional application Ser. No. 60/671,965, filed on Apr. 15, 2005. All disclosure of this application is incorporated herein by reference.

BACKGROUND OF THE INVENTION

1. Field of Invention

The present invention relates to a circuit structure for dual resolution in a display apparatus.

2. Description of Related Art

LCD is one kind of popular flat panel display devices. There are two resolution modes in LCD, normal resolution mode and half resolution mode. In general, LCD is displayed under the normal resolution mode. In some cases, for example, for power-saving or low resolution requirement, LCD will be displayed under the half resolution mode.

FIGS. 1*a* and 1*b* show the definition of unit pixel in the normal resolution mode and the half resolution mode, respectively. Referring to FIG. 1*a*, in the normal resolution mode, one unit pixel includes one individual pixel, with R, G and B three sub-pixels. Referring to FIG. 1*b*, in the half resolution mode, one unit pixel includes four individual pixels. In FIGS. 1*a* and 1*b*, symbols "R", "G" and "B" refer to R/G/B sub-pixels and "R1", "R2", and "R3" refer to first, second and third pixel rows. As known, one individual pixel includes three sub-pixels, or said R/G/B sub-pixels. By defining different unit pixel in FIGS. 1*a* and 1*b*, dual resolution function is made.

Two kinds of vertical scan signals are used to define different unit pixel under different resolution modes. FIG. 2*a* and FIG. 2*b* show two kinds of vertical scan signals, respectively. In FIG. 2*a*, to define the unit pixel under the normal resolution, the vertical scan signal scan one pixel row in one pulse. In FIG. 2*b*, to define the unit pixel under the half resolution, the vertical scan signal scan two pixel rows in one scan pulse.

Taking an LCD panel with 640 pixel rows * 480 channels for example. In this LCD panel, 640 vertical scan signals are required to scan pixel rows. In normal resolution mode, a resolution of 640*480 is displayed. In half resolution mode, a resolution of 320*240 is displayed.

A cost effective and well performance circuit configuration for dual resolution modes in the LCD apparatus is needed.

SUMMARY OF THE INVENTION

One aspect of the invention is to provide a circuit configuration for dual resolution modes in a display apparatus, which is low cost, small area and well performance.

To achieve the above aspect, in one embodiment, a dual resolution circuit for supporting dual resolution display modes in a display apparatus is provided. The dual resolution circuit includes a shift register stage, a dual resolution switch and a logic circuit stage. The shift register stage receives a start pulse and four clock signals to generate intermediate scan signals. The dual resolution switch is controlled by a resolution mode signal to switch signal paths of the intermediate scan signals. The logic circuit stage receives the intermediate scan signals from the shift register stage and the switched intermediate scan signals from the dual resolution switch to generate output scan signals for performing dual resolution modes.

Another embodiment of the invention provides a display apparatus having a dual resolution circuit for supporting dual resolution display modes. The dual resolution circuit includes: a clock generator, generating first, second, third and fourth clock signals; a shift register stage, receiving a start pulse and the first, second, third and fourth clock signals for generating a plurality of intermediate scan signals; a normal/reverse scan switch, receiving a normal scan signal, a reverse scan signal and the start pulse, for controlling a normal scan or a reverse scan of the display apparatus; a dual resolution switch, being controlled by a resolution mode control signal to switch signal paths of the plurality of intermediate scan signals; and a logic circuit stage, receiving the plurality of intermediate scan signals from the shift register stage and the switched plurality of intermediate scan signals from the dual resolution switch to generate a plurality of output scan signals for performing dual resolution display modes in the display apparatus.

Still another embodiment of the invention provides a display panel having a dual resolution circuit for supporting dual resolution display modes. The dual resolution circuit includes: a clock generator, generating first, second, third and fourth clock signals; a shift register stage, receiving a start pulse and the first, second, third and fourth clock signals for generating a plurality of intermediate scan signals; a normal/reverse scan switch, receiving a normal scan signal, a reverse scan signal and the start pulse, for controlling a normal scan or a reverse scan of the display panel; a dual resolution switch, being controlled by a resolution mode control signal to switch signal paths of the plurality of intermediate scan signals; and a logic circuit stage, receiving the plurality of intermediate scan signals from the shift register stage and the switched plurality of intermediate scan signals from the dual resolution switch to generate a plurality of output scan signals for performing dual resolution display modes in the display panel.

Yet another embodiment of the invention provides an electronic device having a display panel. The display panel includes a dual resolution circuit. The dual resolution circuit is used for supporting dual resolution display modes in the display panel. The dual resolution circuit includes: a clock generator, generating first, second, third and fourth clock signals; a shift register stage, receiving a start pulse and the first, second, third and fourth clock signals for generating a plurality of intermediate scan signals; a normal/reverse scan switch, receiving a normal scan signal, a reverse scan signal and the start pulse, for controlling a normal scan or a reverse scan of the display panel; a dual resolution switch, being controlled by a resolution mode control signal to switch signal paths of the plurality of intermediate scan signals; and a logic circuit stage, receiving the plurality of intermediate scan signals from the shift register stage and the switched plurality of intermediate scan signals from the dual resolution switch to generate a plurality of output scan signals for performing dual resolution display modes in the display panel.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1B:
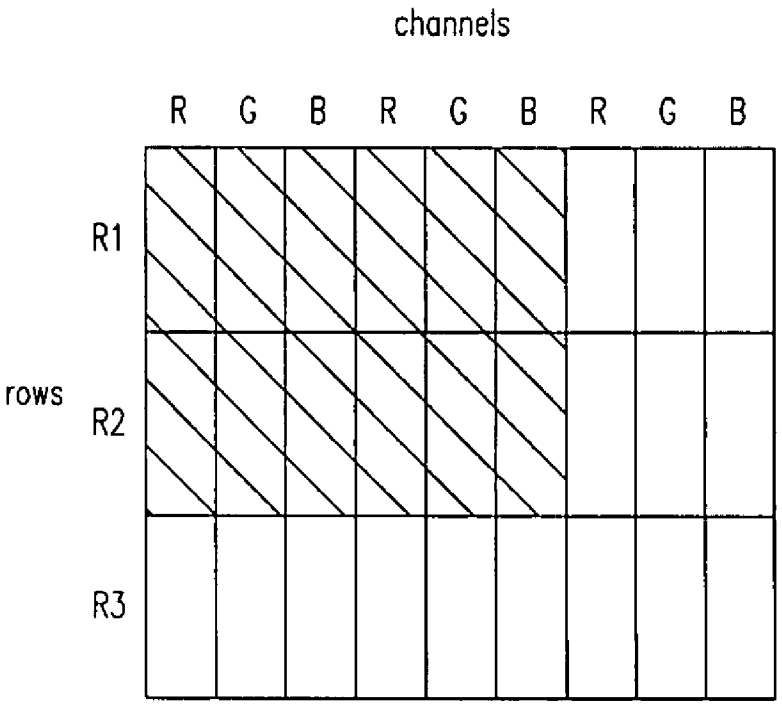
FIGS. 1*a* and 1*b* show the definition of unit pixel under the normal resolution mode and half resolution mode, respectively.
Figure 1A:
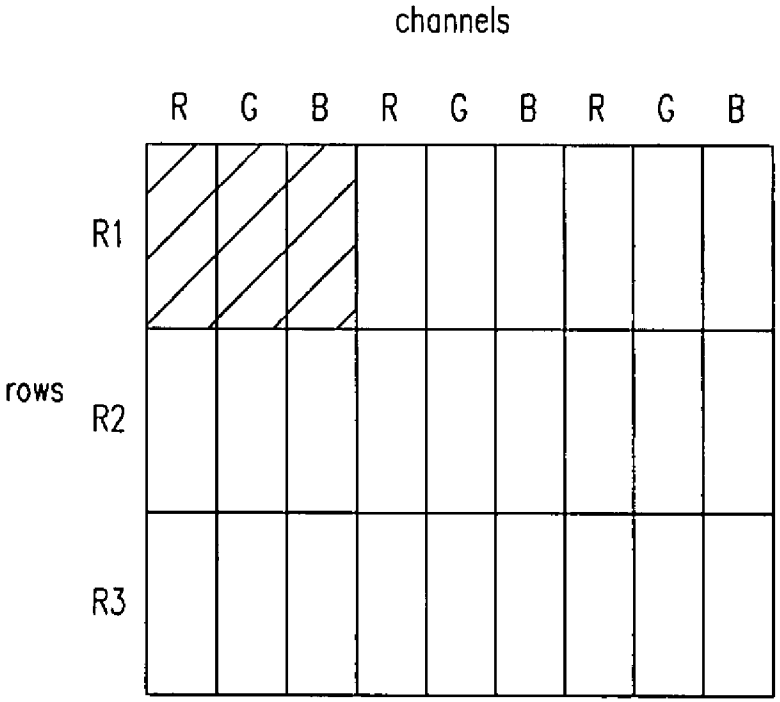

Reference will now be made in detail to the present embodiments of the invention, examples of which are illustrated in the accompanying drawings. Wherever possible, the same reference numbers are used in the drawings and the description to refer to the same or like parts.

Figure 2A:
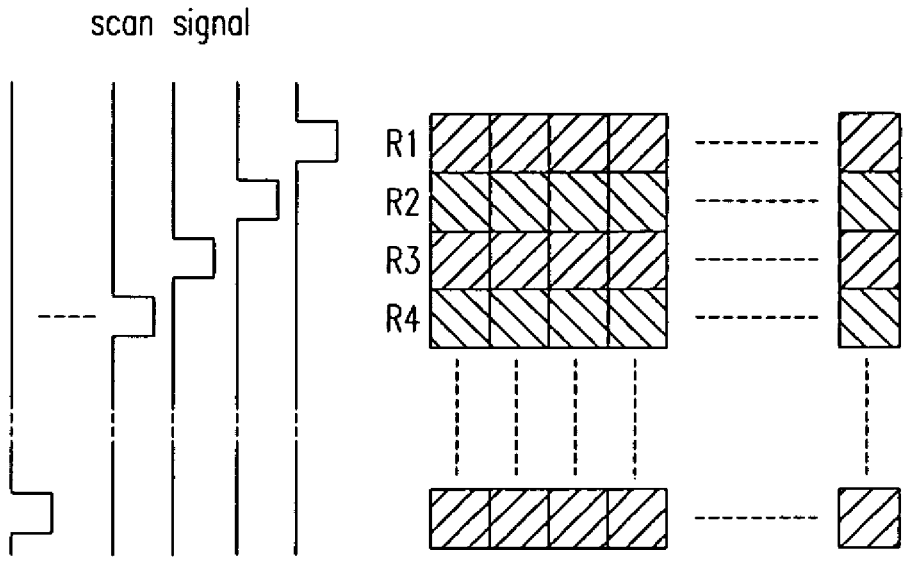
FIGS. 2*a* and 2*b* show two kinds of horizontal scan signals used in the normal resolution mode and half resolution mode, respectively.
Figure 2B:
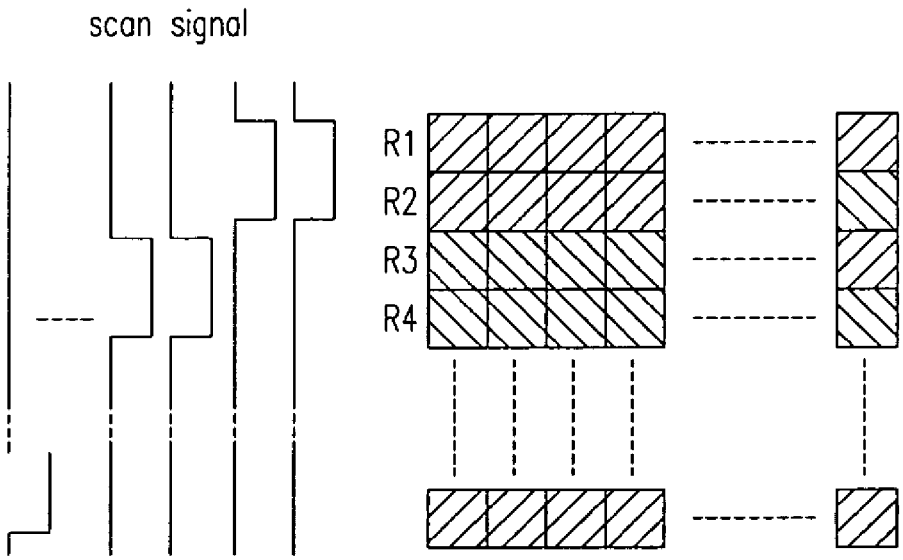
Figure 3:
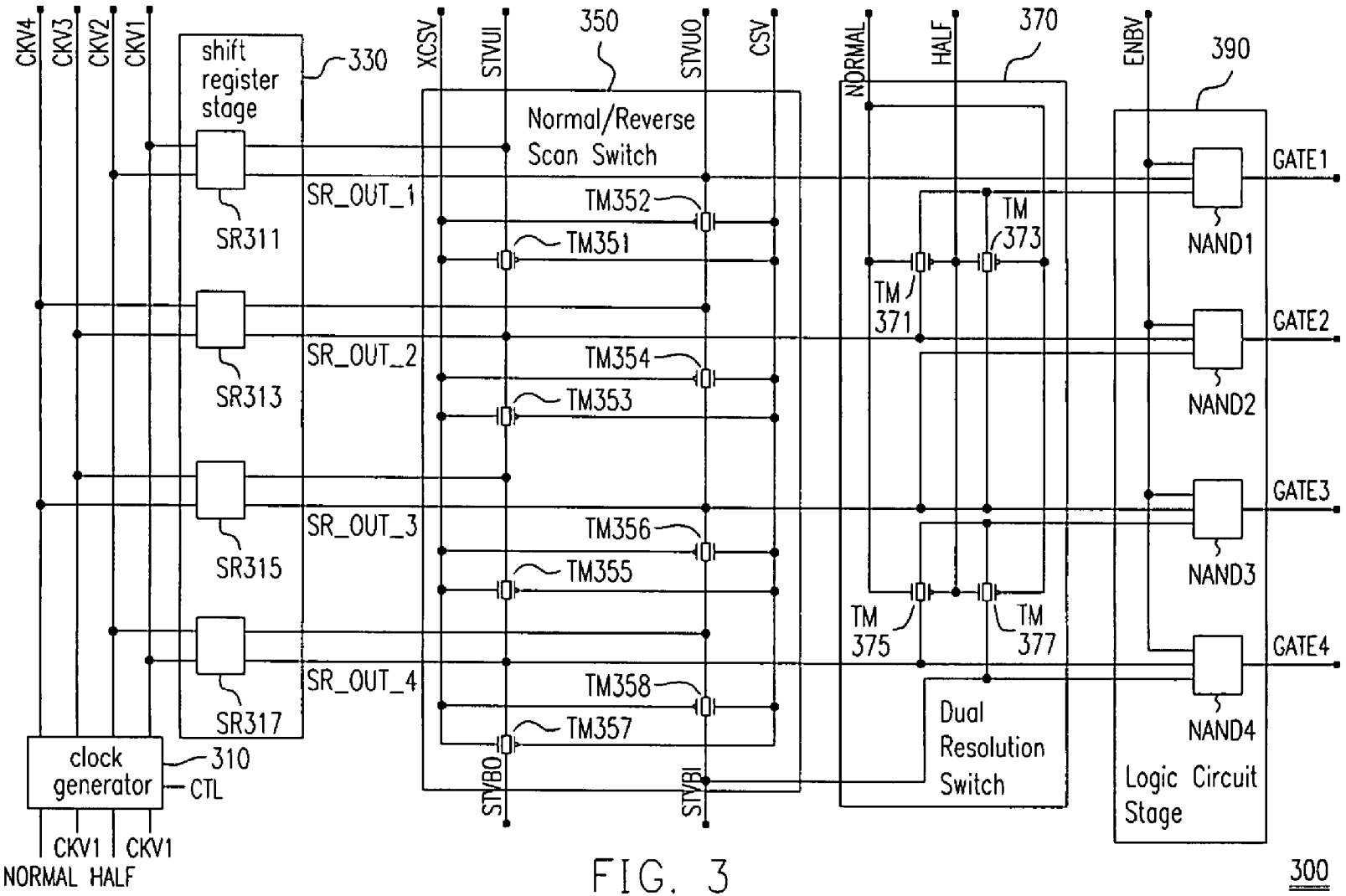
FIG. 3 shows a block diagram of a dual resolution circuit according to one preferred embodiment of the present invention.

FIG. 3 shows a block diagram of dual resolution circuit according to one embodiment of the present invention. The dual resolution circuit generates output signals GATE1~GATE4 which function as the scan signals of FIG. 2*a* or FIG. 2*b* under different resolution display modes. Referring to FIG. 3, the dual resolution circuit 300 at least includes a clock generator 310, a shift register state 330, a normal/reverse scan switch 350, a dual resolution switch 370 and a logic circuit stage 390.

Figure 4A:
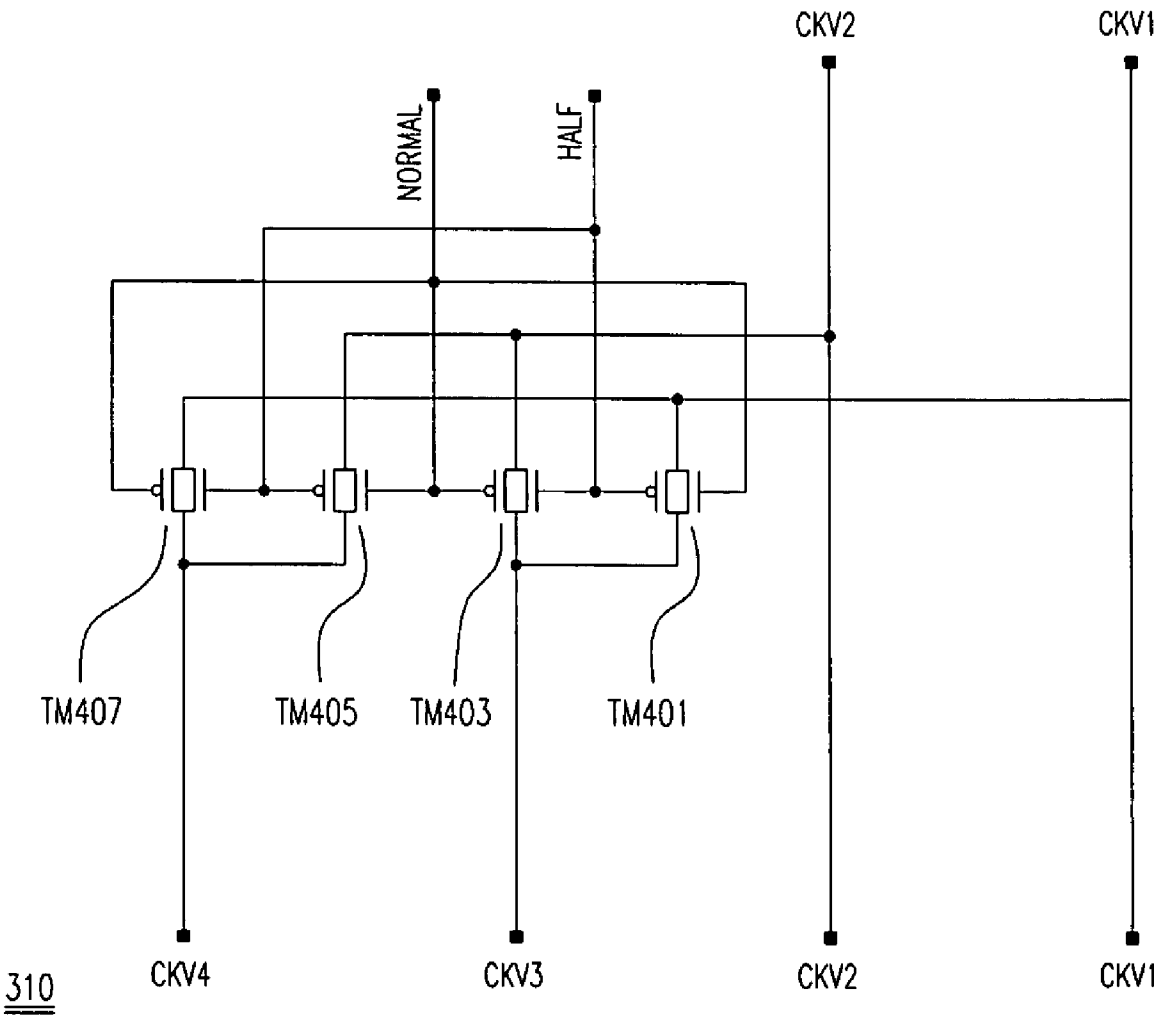
FIG. 4*a* shows a block diagram of a clock generator in the dual resolution circuit of FIG. 3
Figure 4B:
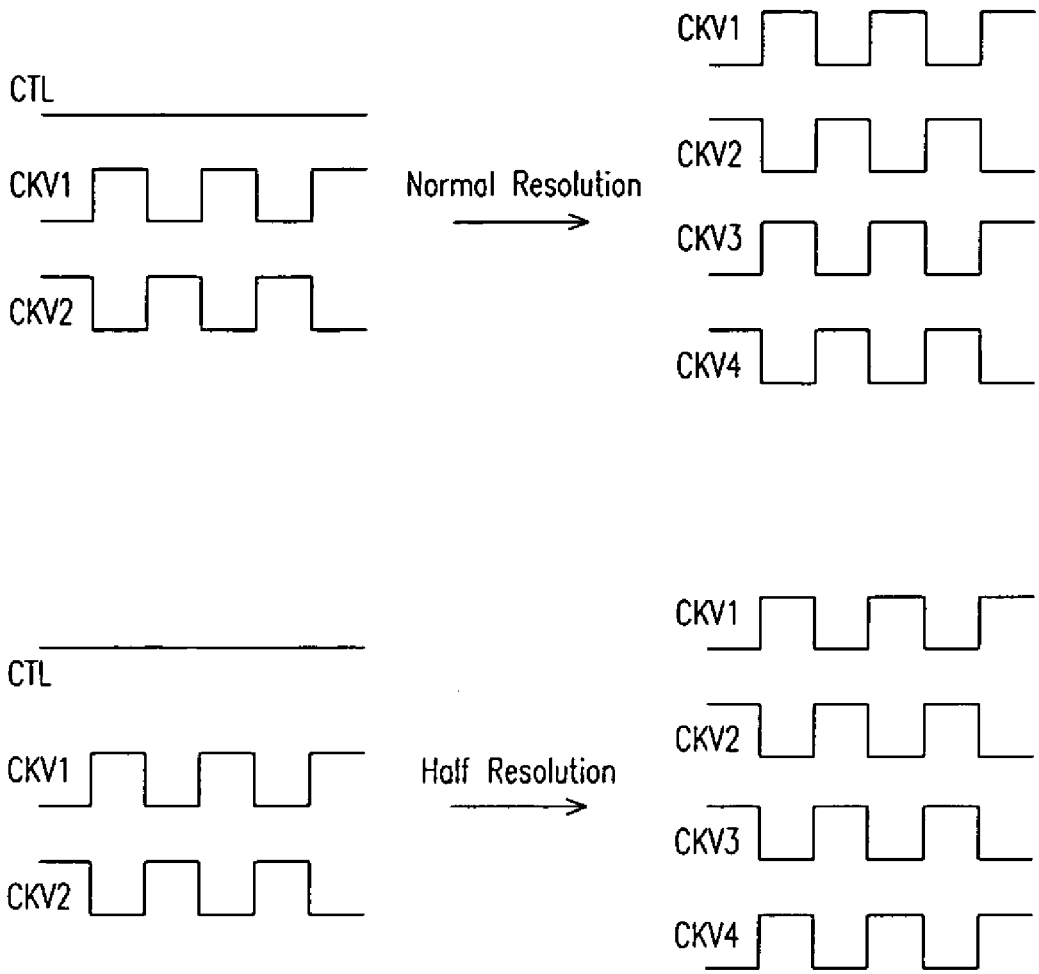
FIG. 4*b* shows waveforms of the clock signals from the clock generator of FIG. 4*a*.

The clock generator 310 generates four clock signals CKV1, CKV2, CKV3 and CKV4 based on a control signal CTL, two original clock signals CKV1, CKV2 and two resolution mode control signals NORMAL and HALF. Wherein, CKV2 is an inverted signal of CKV1. The operation of the clock generator 310 and waveforms of the signals thereof are shown in FIGS. 4*a* and 4*b*, which will be described more detailed later.

The shift register stage 330 receives the clock signals CKV1, CKV2, CKV3 and CKV4 from the clock generator 310 and further a start pulse. The shift register stage 330 includes at least four cascaded shift registers SR311, SR313, SR315 and SR317. The clock signals CKV1 and CKV2 are input into the shift register SR311; the clock signals CKV3 and CKV4 are input into the shift register SR313; the clock signals CKV3 and CKV4 are input into the shift register SR315; and the clock signals CKV1 and CKV2 are input into the shift register SR317. The shift register stage 330 generates intermediate scan signals SR_OUT_1, SR_OUT_2, SR_OUT_3 and SR_OUT_4, which is processed by the logic circuit stage 390 via the normal/reverse scan switch 350 and the dual resolution switch 370 to generate the scan signals GATE1~GATE4. The start pulse received by the shift register stage 330 is either the signal STVUI if under a normal scan mode or the signal STVBI if under a reverse scan mode.

Figure 5:
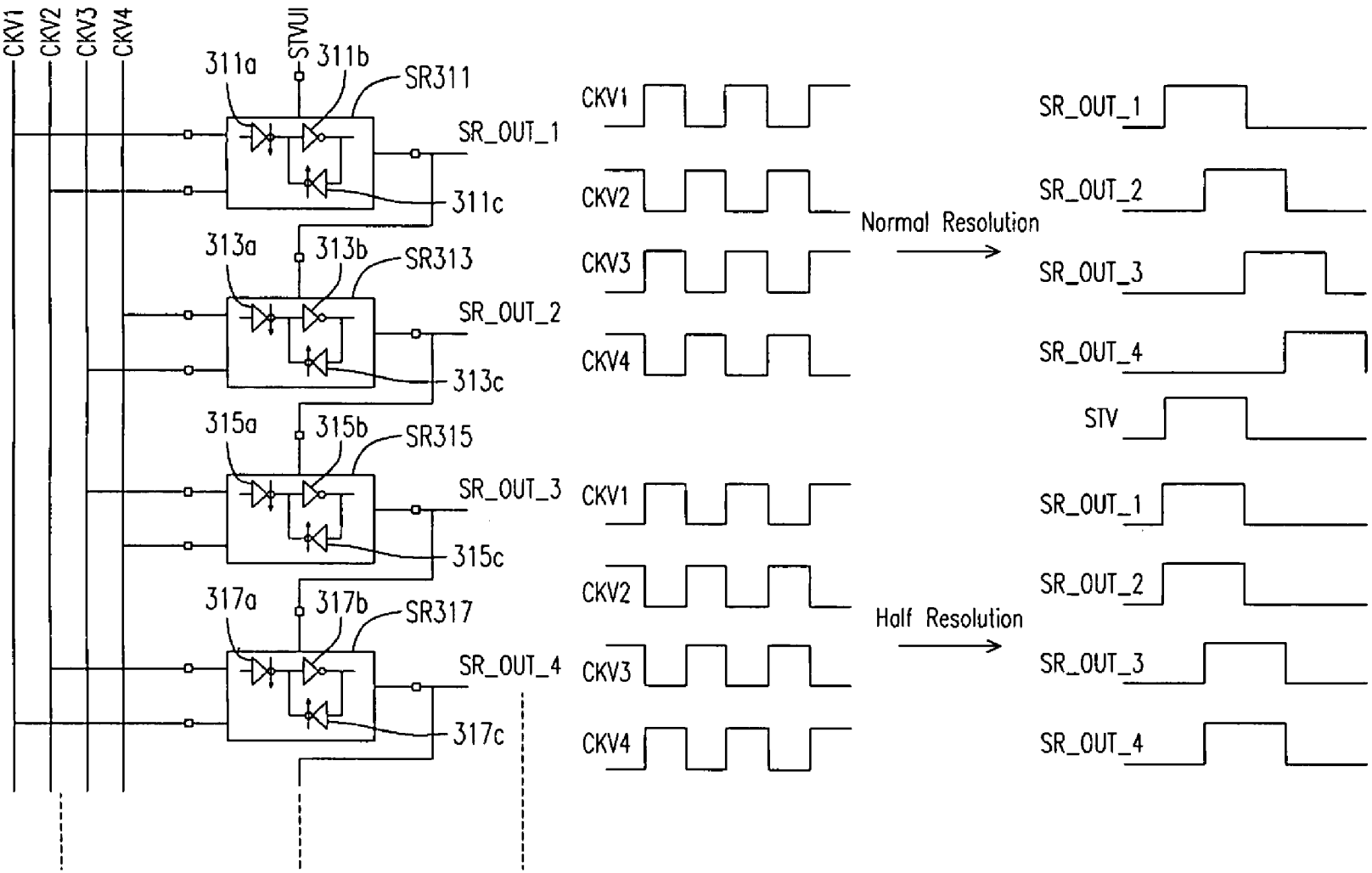
FIG. 5 shows a block diagram of a shift register stage in the dual resolution circuit of FIG. 3 and waveforms thereof.

The operation of the shift register stage 330 and waveforms of the signals thereof are shown in FIG. 5, which will be described more detailed later.

The normal/reverse scan switch 350 controls a normal or reverse scan based on normal/reverse scan control signals CSV and XCSV. The switch 350 at least includes eight transmission gates TM351~TM358. In the normal scan mode, the pixel rows are scanned in a direction, for example, from top to bottom. In the reverse scan mode, the pixel rows are scanned in a reverse direction, for example, from bottom to top. Signal XCSV is an inverted signal of signal CSV. When a normal scan operation is required, the signal CSV is logic H, or said the signal XCSV is logic L. On the other hand, when a reverse scan operation is required, the signal XCSV is logic H, or said the signal CSV is logic L. The detail operation of the switch 350 is described later by referring FIGS. 8*a*~8*d*.

The dual resolution switch 370 controls a normal resolution mode or a half resolution mode based on normal/half resolution control signals NORMAL and HALF. The dual resolution switch 370 at least includes four transmission gates TM371~TM377. The dual resolution switch 370 conduct appropriate signals SR_OUT_1~SR_OUT_4 to the logic circuit stage 390 for generating output scan signals GATE1~GATE4 under the normal resolution mode and the half resolution mode. The detail operation of the switch 370 is described later by referring FIGS. 6, 7 and 8*a*~8*d*. If a normal resolution mode is required, the signal NORMAL is logic H and the signal HALF is logic L. If a half resolution mode is required, the signal NORMAL is logic L and the signal HALF is logic H.

The logic circuit stage 390 includes at least four NAND gates NAND1~NAND4. The stage 390 performs logic operation on the output signals from the shift register stage 330 and an enablement signal ENBV to produce output scan signals GATE1~GATE4. In this embodiment, under normal resolution mode, overlapping between output scan signals GATE1~GATE4 is prevented by NAND logic operation.

FIG. 4*a* shows a block diagram of the clock generator 310 in the dual resolution circuit of FIG. 3 and FIG. 4*b* shows waveforms of the clock signals from the clock generator of FIG. 4*a*. As shown in FIG. 4*a*, the clock generator 310 includes four transmission gates TM401, TM403, TM405 and TM407. On/off states of the transmission gates are controlled by signals NORMAL and HALF. When NORMAL is logic H and HALF is logic L, i.e. under normal resolution mode, TM403 and TM 407 are on; and TM401 and TM 405 are off. So, under normal resolution mode, CKV3=CKV1 and CKV4=CKV2. Similarly, when NORMAL is logic L and HALF is logic H, i.e. under half resolution mode, TM403 and TM 407 are off; and TM401 and TM 405 are on. So, under normal resolution mode, CKV4=CKV1 and CKV3=CKV2. Waveforms of CKV1~CKV4 under different resolution modes are shown is FIG. 4*b*. The clock signals CKV1~CKV4 are used to control operation states of the shift registers in the next stage 330.

FIG. 5 shows a block diagram of the shift register stage 330 in the dual resolution circuit of FIG. 3 and waveforms thereof. The shift register stage 330 includes at least four cascaded shift registers SR311, SR313, SR315 and SR317. For simplicity, only four shift registers are shown in FIGS. 3 and 5, but the present invention are not limited thereby. Each shift register includes two clock inverters and one inverter. The shift register SR311 includes two clock inverters 311*a* and 311*c* and one inverter 311*b*. The shift register SR313 includes two clock inverters 313*a* and 313*c* and one inverter 313*b*. The shift register SR315 includes two clock inverters 315*a* and 315*c* and one inverter 315*b*. The shift register SR317 includes two clock inverters 317*a* and 317*c* and one inverter 317*b*. The clock inverter has two operation states, latch state and transmission state. In latch state, the output signal of the shift register is latched. In the transmission state, the input signal is transmitted as the output signal. The configuration of the shift registers and the clock inverters are not specially limited.

As shown in FIGS. 3 and 5, the clock signals CKV1~CKV4 are used to control states of the shift register SR311~SR317. For example, clock signals CKV1 and CKV2 are used to control the shift register SR311. A start pulse received by the shift register stage 330 is either the signal STVUI if under a normal scan mode or the signal STVBI if under a reverse scan mode. Besides, the start pulse is input to the first or last shift register, depending on the normal/reverse scan mode. FIG. 5 only shows under normal scan mode, a start pulse STV (STVUI) is fed into the first shift register SR311 as an input signal, and output signals from a previous shift register are fed into a next shift register as an input. For example, under normal scan mode, the signal SR_OUT_1 from the shift register SR311 are input into the shift register SR313 as an input. On the other hand, under reverse scan mode, a start pulse STVBI is fed into the last shift register SR317 as an input signal, and output signals from a next shift register are fed into a previous shift register as an input, although this case is not shown in FIG. 5 for clarity. For example, under reverse scan mode, the signal SR_OUT_4 from the shift register SR317 are input into the shift register SR315 as an input signal. The normal/reverse scan switch 350 is used to conduct appropriate start pulse and signal into the shift registers. The detailed conducting operation is described later by referring FIGS. 8*a*~8*d*.

Figure 6:
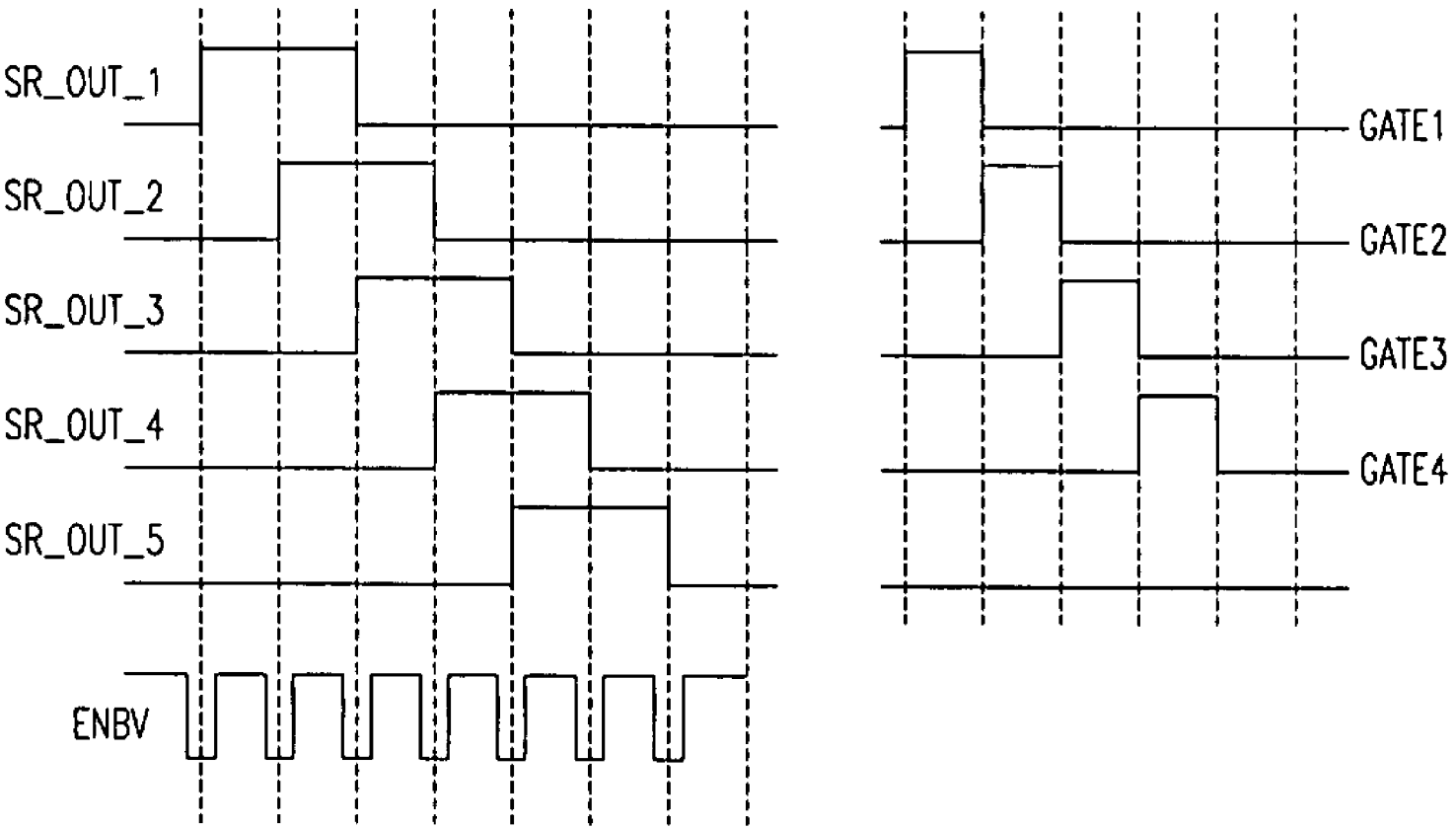
FIG. 6 shows a waveform of output scan signals under the normal resolution mode.

FIG. 6 shows a waveform of output scan signals GATE1~GATE4 under the normal resolution mode. Under normal resolution mode, to generate output scan signals GATE1~GATE4 as waveforms in FIG. 2*a*, GATE1~GATE4 are expressed by:

GATE1=NAND (SR_OUT_1, SR_OUT_2, ENBV);
GATE2=NAND (SR_OUT_2, SR_OUT_3, ENBV);
GATE3=NAND (SR_OUT_3, SR_OUT_4, ENBV);
GATE4=NAND (SR_OUT_4, SR_OUT_5, ENBV).

Signal SR_OUT_5, not shown in attached figures, refer to an output signal from fifth shift register (not shown) in the stage 330. Although only four shift registers in the stage 330 and four scan control signals GATE1~GATE4 are shown in FIG. 3, the embodiment is not limited thereby. For example, if there are 640 pixel rows in an LCD panel, then 640 scan signals GATE 1~GATE640 and 640 shift registers in the stage 330 are required.

Figure 7:
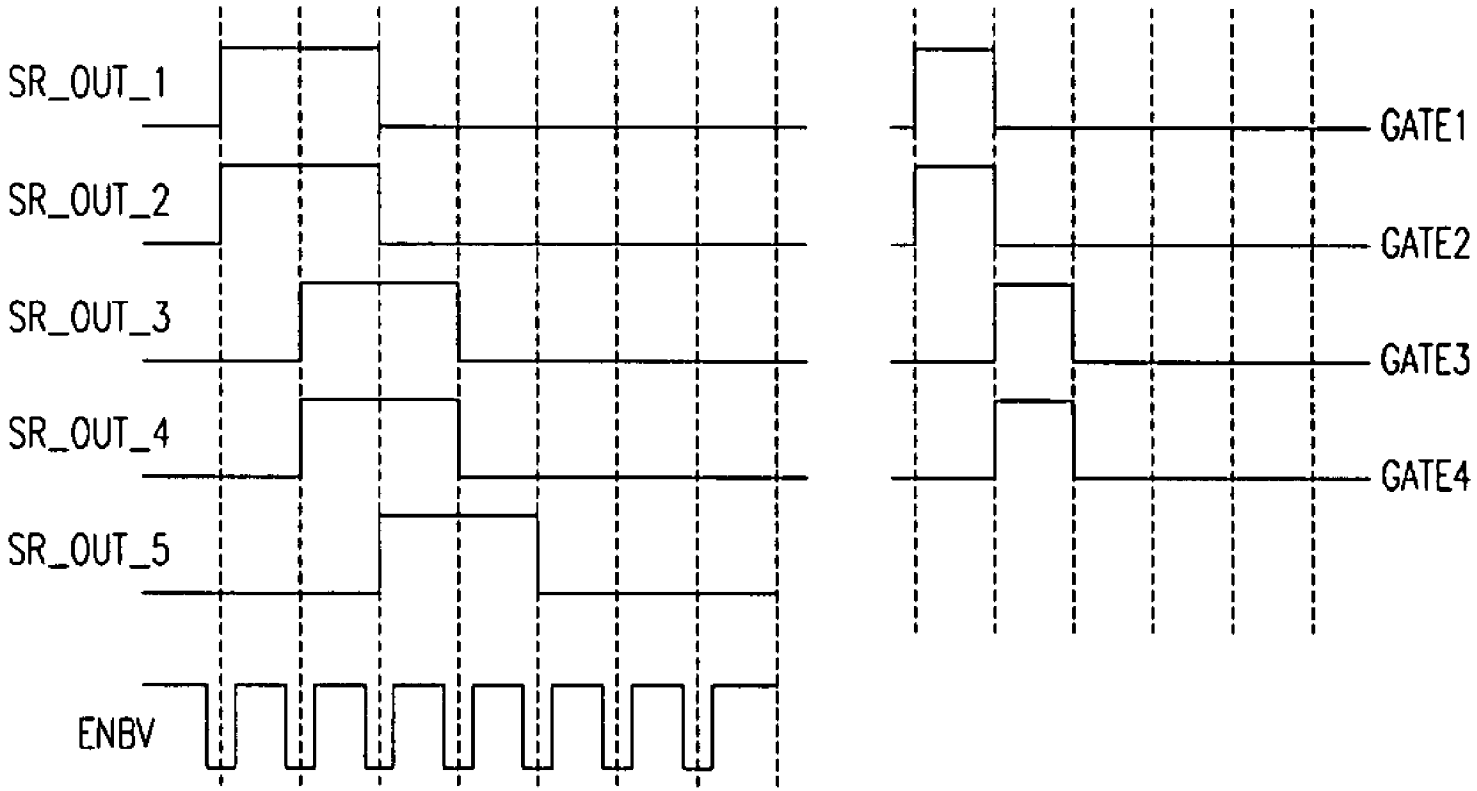
FIG. 7 shows a waveform of output scan signals under the half resolution mode.

FIG. 7 shows a waveform of output signals under the half resolution mode. Under half resolution mode, to generate output scan signals GATE1~GATE4 as waveforms in FIG. 2*b*, GATE1~GATE4 are expressed by:

GATE1=NAND (SR_OUT_1, SR_OUT_3, ENBV);
GATE2=NAND (SR_OUT_2, SR_OUT_3, ENBV);
GATE3=NAND (SR_OUT_3, SR_OUT 5, ENBV);
GATE4=NAND (SR_OUT_4, SR_OUT_5, ENBV).

As shown in FIG. 3, the output signals SR_OUT_1~SR_OUT_4 from the shift register stage 330 is passed by the switch 350 into the switch 370, so the switch 350 is not shown in FIGS. 6 and 7.

FIGS. 8*a*~8*d* show signal paths under normal/reverse scan and normal/half resolution modes of FIG. 3.

Figure 8A:
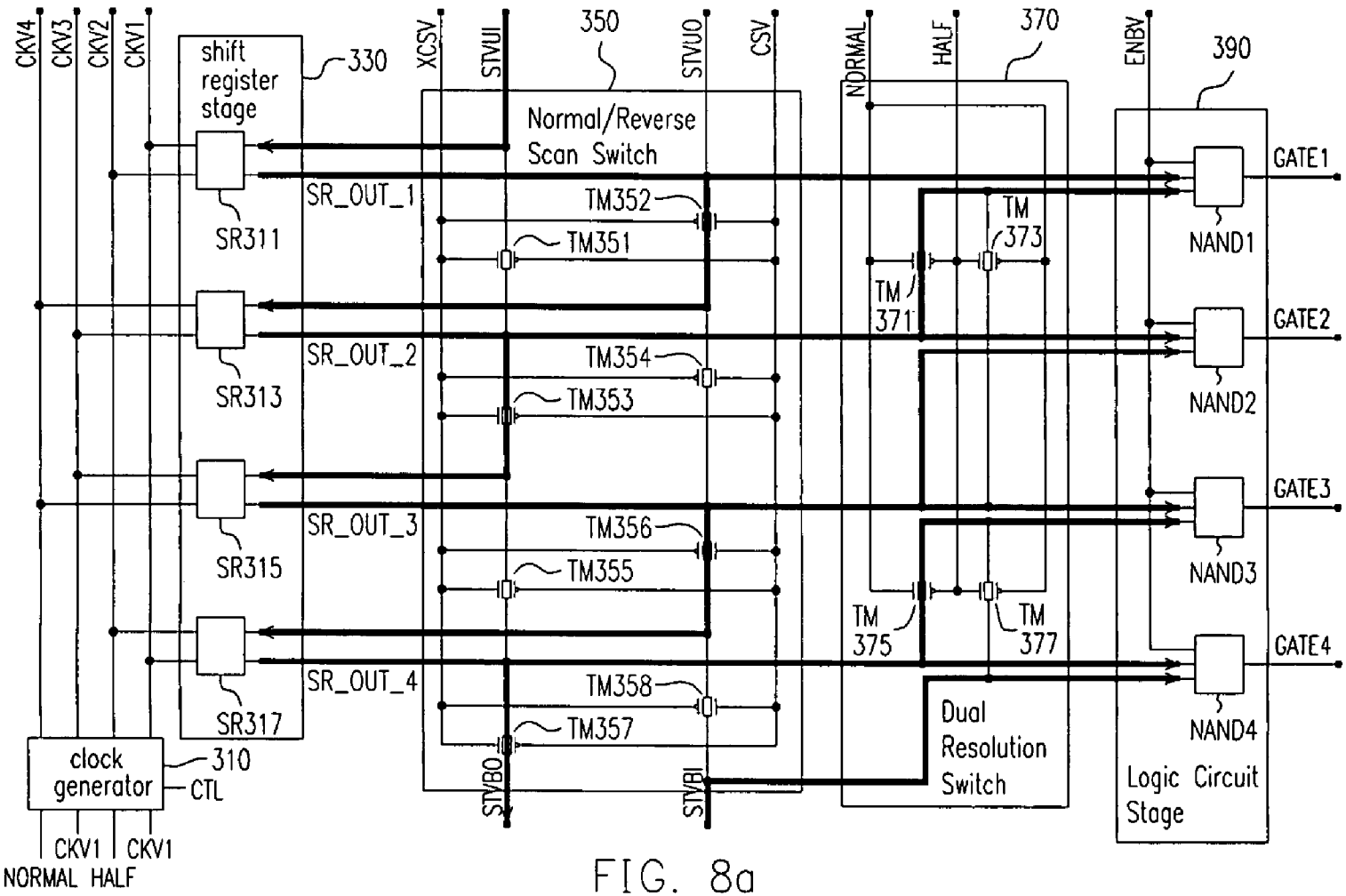
FIGS. 8*a*~8*d* show signal paths under normal/reverse scan and normal/half resolution modes of FIG. 3.

FIG. 8*a* shows the signal paths under normal scan and normal resolution modes. Under this case, the transmission gates TM352, TM353, TM356 and TM357 in the switch 350 are conducted and the transmission gates TM371 and TM375 in the switch 370 are conducted. The pulse STVUI is fed into the shift register SR311 and the pulse STVBO is generated from the shift register SR317. The pulse STVBI is fed into the NAND4 as an input.

Figure 8B:
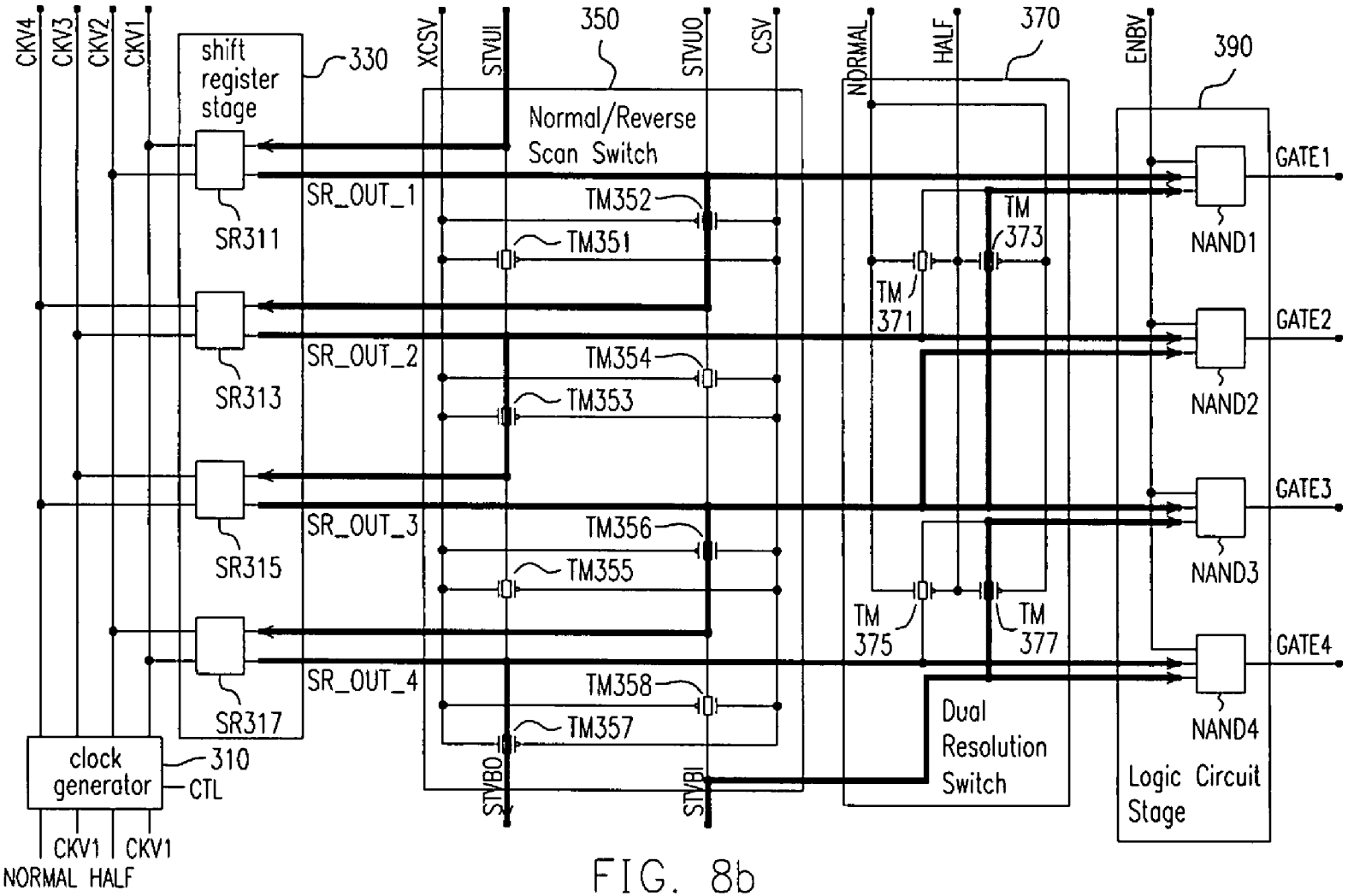

FIG. 8*b* shows the signal paths under normal scan and half resolution modes. Under this case, the transmission gates TM352, TM353, TM356 and TM357 in the switch 350 are conducted and the transmission gates TM373 and TM377 in the switch 370 are conducted. The pulse STVUI is fed into the shift register SR311 and the pulse STVBO is generated from the shift register SR317. The pulse STVBI is fed into the NAND4 as an input.

Figure 8C:
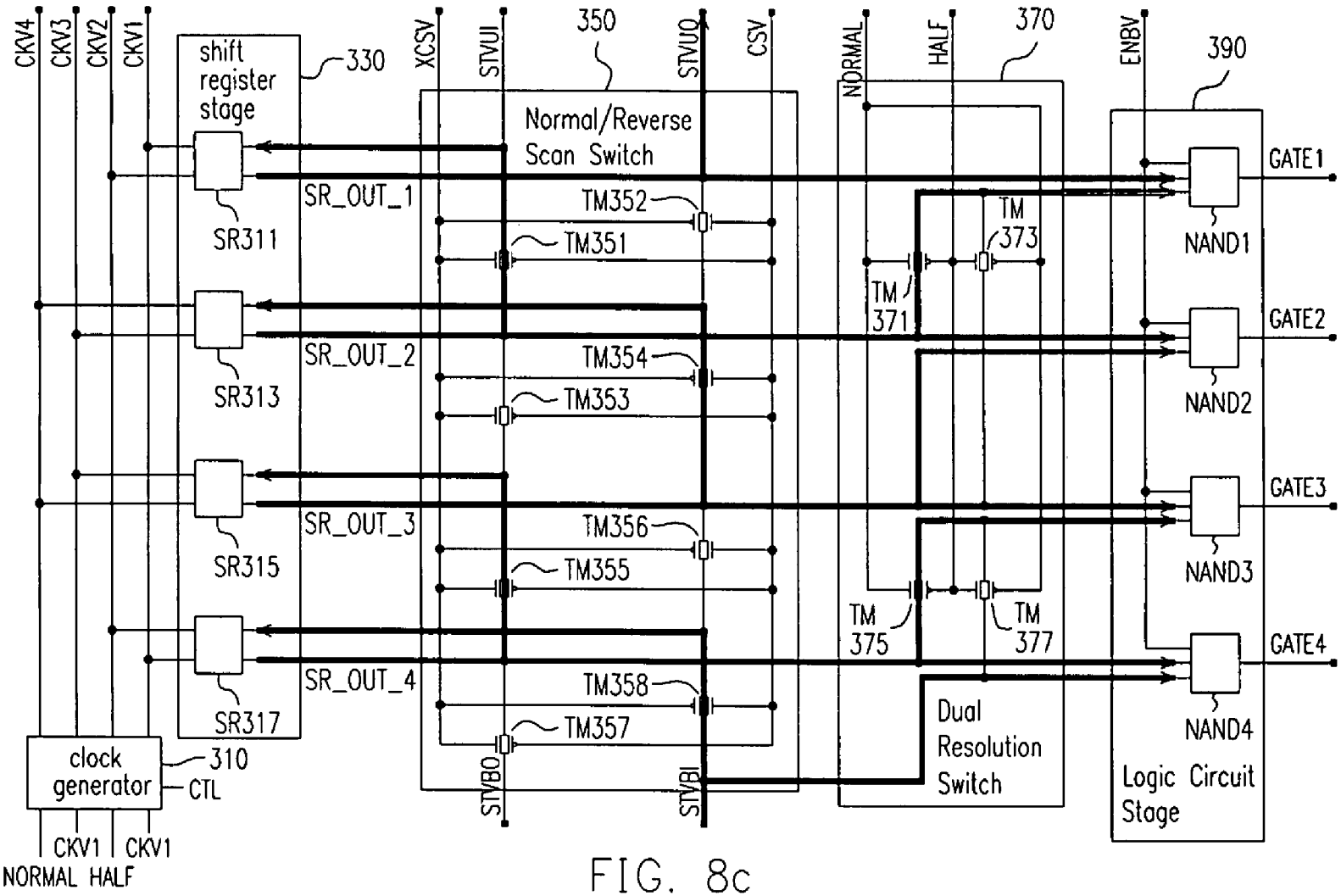

FIG. 8*c* shows the signal paths under reverse scan and normal resolution modes. Under this case, the transmission gates TM351, TM354, TM355 and TM358 in the switch 350 are conducted and the transmission gates TM371 and TM375 in the switch 370 are conducted. The pulse STVBI is fed into the shift register SR317 and the pulse STVUO is generated from the shift register SR311.

Figure 8D:
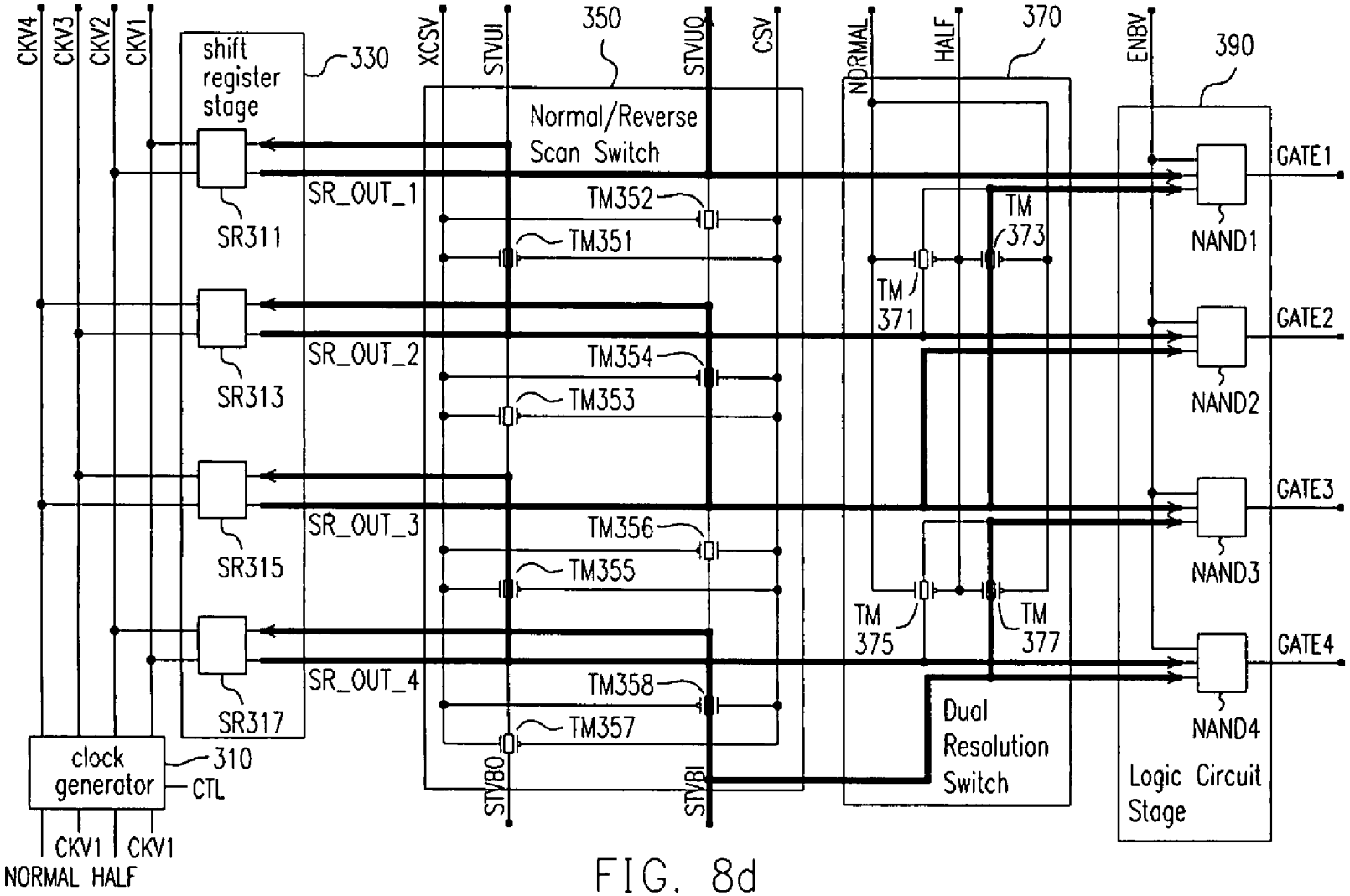

FIG. 8*d* shows the signal paths under reverse scan and half resolution modes. Under this case, the transmission gates TM351, TM354, TM355 and TM358 in the switch 350 are conducted and the transmission gates TM373 and TM377 in the switch 370 are conducted. The pulse STVBI is fed into the shift register SR317 and the pulse STVUO is generated from the shift register SR311.

By the embodiment, a dual resolution circuit configuration for supporting the normal resolution mode and the half resolution mode is achieved. The dual resolution circuit configuration is cost-effective and good performance.

Figure 9:
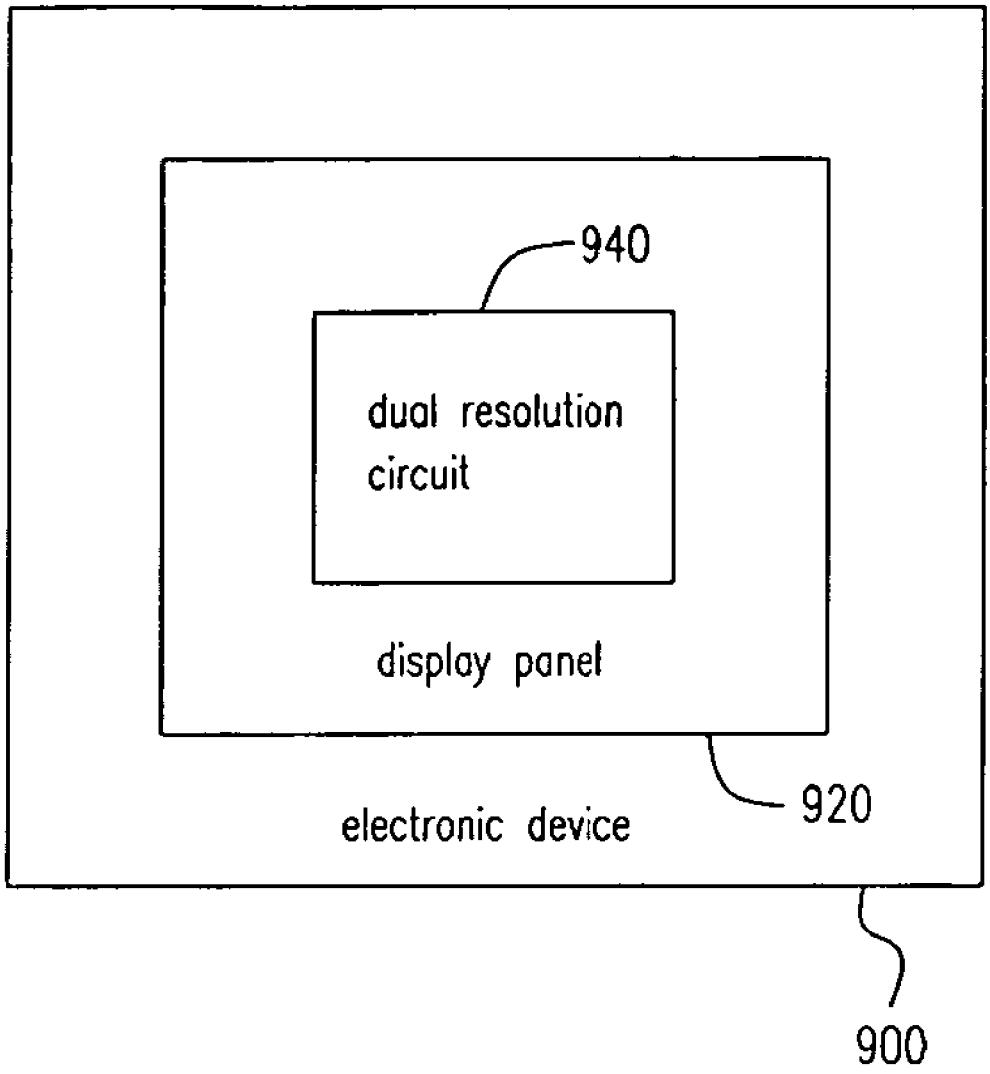
FIG. 9 shows an electronic device according to another embodiment of the invention.

FIG. 9 shows an electronic device according to another embodiment of the invention. In FIG. 9, the electronic device 900 at least includes a display panel 920 and the display panel 920 at least includes a dual resolution circuit 940 for supporting dual resolution display modes in the display panel 920. The dual resolution circuit 940 are for example, the same or similar to the dual resolution circuit 300 in FIG. 3. The electronic device may be, for example but not limited to, a PDA (personal digital assistance), a mobile phone etc. The signals STVUO (start pulse up out) and STVBO (start pulse bottom out) are used for circuit functional test.

It will be apparent to those skilled in the art that various modifications and variations can be made to the structure of the present invention without departing from the scope or spirit of the invention. In view of the foregoing descriptions, it is intended that the present invention covers modifications and variations of this invention if they fall within the scope of the following claims and their equivalents.

What is claimed is:

1. A dual resolution circuit for supporting dual resolution display modes in a display apparatus, comprising:

a shift register stage, receiving a start pulse and at least four clock signals, generating a plurality of intermediate scan signals;

a dual resolution switch, controlled by a resolution mode control signal to switch signal paths of the plurality of intermediate scan signals; and a logic circuit stage, including a plurality of NAND gates, wherein each of the NAND gates directly receives an enablement signal and receives one of the intermediate scan signals from the shift register stage and one of the switched intermediate scan signals from the dual resolution switch, and performing logic operations on the enablement signal, the intermediate signals and the switched intermediate scan signals to generate a plurality of output scan signals for performing dual resolution display modes, wherein: the dual resolution display modes includes a normal resolution display mode and a half resolution display mode, each NAND gate corresponding to a separate one of the plurality of intermediate scan signals, the plurality of intermediate scan signals include first, second and third intermediate scan signals, and the NAND gate corresponding to the first intermediate scan signal performs logic operations on the enablement signal, the first intermediate signal, and either the second intermediate scan signal or the third intermediate scan signal that is switched from the dual resolution switch to generate the output scan signals depending on which of the normal resolution display mode or the half resolution display mode.

2. The dual resolution circuit of claim 1, further comprising:

a clock generator, receiving first and second clock signals, controlled by the resolution mode signal and generating first, second, third and fourth clock signals based on the first and second clock signals, wherein the clock generator outputs the first, second, third and fourth clock signals to the shift register stage.

3. The dual resolution circuit of claim 2, wherein the dual resolution display modes include a normal resolution display mode and a half resolution display mode, and under the normal resolution display mode, the third clock signal is corresponding to the first clock signal and the fourth clock signal is corresponding to the second clock signal.

4. The dual resolution circuit of claim 3, wherein under the half resolution display mode, the third clock signal is corresponding to the second clock signal and the fourth clock signal is corresponding to the first clock signal.

5. The dual resolution circuit of claim 1, wherein the shift register stage includes a plurality of cascaded shift registers, operation states of the shift registers are controlled by the clock signals, and under a normal scan mode, first of the cascaded shift registers receives the start pulse, and output signals from the cascaded shift registers function as the intermediate scan signals into the logic circuit stage; and under a reverse scan mode, last of the cascaded shift registers receives the start pulse, and output signals from the cascaded shift registers function as the intermediate scan signals into the logic circuit stage.

6. The dual resolution circuit of claim 5, further comprising:

a normal/reverse scan switch, receiving a normal scan signal, a reverse scan signal and the start pulse, the normal/reverse scan switch conducting output signal from one of the cascaded shift registers into another shift register.

7. The dual resolution circuit of claim 6, wherein the normal scan signal is an inverted signal of the reverse scan signal, and under a normal scan mode, the output of a previous shift register is fed into a next shift register as an input; or under a reverse scan mode, the output of a next shift register is fed into a previous shift register as an input.

8. The dual resolution circuit of claim 6, wherein the normal/reverse scan switch includes first and second groups of cascaded transmission gates, and under a normal scan mode, the first group of the cascaded transmission gates is conducted and second group of the transmission gates is off; or under a reverse scan mode, the second group of the cascaded transmission gates is conducted and first group of the transmission gates is off.

9. The dual resolution circuit of claim 1, wherein the dual resolution switch includes third and fourth groups of transmission gates, and under a normal resolution display mode, the third group of the transmission gates is conducted and fourth group of the transmission gates is off; or under a half resolution display mode, the fourth group of the transmission gates is conducted and third group of the transmission gates is off.

10. The dual resolution circuit of claim 1, wherein each of the NAND gates directly receives said one of the intermediate scan signals from the shift register stage and said one of the switched intermediate scan signals from the dual resolution switch.

11. The dual resolution circuit of claim 1, wherein:

to generate the output scan signals in the normal resolution display mode, the dual resolution switch switches the second intermediate scan signal, and the NAND gate in the logic circuit stage corresponding to the first intermediate scan signal performs logic operations on the enablement signal, the first intermediate signal, and the second intermediate scan signal that is switched from the dual resolution switch, and to generate the output scan signals in the half resolution display mode, the dual resolution switch switches the third intermediate scan signal, and the NAND gate in the logic circuit stage corresponding to the first intermediate scan signal performs logic operations on the enablement signal, the first intermediate signal, and the third intermediate scan signal that is switched from the dual resolution switch.

12. The dual resolution circuit of claim 1, wherein the shift register stage generates intermediate scan signals in accordance with the resolution mode control signal, including: (a) four dissimilar sequential intermediate scan signals, in the normal resolution display mode; and (b) a first set of two similar sequential intermediate scan signals, followed by a second set of two similar sequential intermediate scan signals, wherein the second set is different from the first set, in the half resolution display mode.

13. A display panel, comprising:

a dual resolution circuit for supporting dual resolution display modes in the display panel, the dual resolution circuit including:

a clock generator, generating at least four clock signals;

a shift register stage, receiving a start pulse and at least four clock signals for generating a plurality of intermediate scan signals;

a normal/reverse scan switch, receiving a normal scan signal, a reverse scan signal and the start pulse, for controlling a normal scan or a reverse scan of the display panel;

a dual resolution switch, being controlled by a resolution mode control signal to switch signal paths of the plurality of intermediate scan signals; and a logic circuit stage, including a plurality of NAND gates, wherein each of the NAND gates directly receives an enablement signal and receives one of the intermediate scan signals from the shift register stage and one of the switched intermediate scan signals from the dual resolution switch, and performing logic operations on the enablement signal, the intermediate signals and the switched intermediate scan signals to generate a plurality of output scan signals for performing dual resolution display modes in the display panel, wherein: the dual resolution display modes includes a normal resolution display mode and a half resolution display mode, each NAND gate corresponding to a separate one of the plurality of intermediate scan signals, the plurality of intermediate scan signals include first, second and third intermediate scan signals, and the NAND gate corresponding to the first intermediate scan signal performs logic operations on the enablement signal, the first intermediate signal, and either the second intermediate scan signal or the third intermediate scan signal that is switched from the dual resolution switch to generate the output scan signals depending on which of the normal resolution display mode or the half resolution display mode.

14. An electronic device having a display panel as in claim 13.

15. The display panel of claim 13, wherein each of the NAND gates directly receives said one of the intermediate scan signals from the shift register stage and said one of the switched intermediate scan signals from the dual resolution switch.

16. The display panel as in claim 13, wherein:

to generate the output scan signals in the normal resolution display mode, the dual resolution switch switches the second intermediate scan signal, and the NAND gate in the logic circuit stage corresponding to the first intermediate scan signal performs logic operations on the enablement signal, the first intermediate signal, and the second intermediate scan signal that is switched from the dual resolution switch, and to generate the output scan signals in the half resolution display mode, the dual resolution switch switches the third intermediate scan signal, and the NAND gate in the logic circuit stage corresponding to the first intermediate scan signal performs logic operations on the enablement signal, the first intermediate signal, and the third intermediate scan signal that is switched from the dual resolution switch.

17. A dual resolution circuit for supporting dual resolution display modes, including a normal resolution display mode and a half resolution display mode, in a display apparatus, comprising:

a shift register stage, receiving a plurality of clock signals, and generating a plurality of intermediate scan signals, including a first, second and third intermediate scan signals;

a dual resolution switch, controlled by a resolution mode control signal to switch signal paths of at least the first, second and third intermediate scan signals; and a logic circuit stage receiving the plurality of intermediate scan signals from the shift register stage and the switched intermediate scan signals from the dual resolution switch, and generating a plurality of output scan signals for performing the dual resolution display modes, wherein the logic circuit stage performs logic operations on the first intermediate signal, and either the second intermediate scan signal or the third intermediate scan signal switched from the dual resolution switch, to generate the output scan signals depending on which of the normal resolution display mode or the half resolution display mode wherein: the logic circuit stage includes a plurality of NAND gates, each of the NAND gates corresponds to a separate one of the plurality of intermediate scan signals, and the NAND gate corresponding to the first intermediate scan signal performs logic operations on the first intermediate signal, and either the second intermediate scan signal or the third intermediate scan signal switched from the dual resolution switch, to generate the output scan signals depending on which of the normal resolution display mode or the half resolution display mode.

18. The dual resolution circuit of claim 17, wherein:

to generate the output scan signals in the normal resolution display mode, the dual resolution switch switches the second intermediate scan signal, and the NAND gate in the logic circuit stage corresponding to the first intermediate scan signal performs logic operations on the first intermediate signal and the second intermediate scan signal switched from the dual resolution switch, and to generate the output scan signals in the half resolution display mode, the dual resolution switch switches the third intermediate scan signal, and the NAND gate in the logic circuit stage corresponding to the first intermediate scan signal performs logic operations on the first intermediate signal and the third intermediate scan signal switched from the dual resolution switch.

19. The dual resolution circuit of claim 17, wherein the shift register stage generates intermediate scan signals in accordance with the resolution mode control signal, including: (a) dissimilar sequential first, second and third intermediate scan signals, in the normal resolution display mode; and (b) similar sequential first and second intermediate scan signals, and sequential third intermediate signal that is dissimilar to the first and second intermediate scan signals, in the half resolution display mode.

* * * * *